US006637922B2

(12) United States Patent
Lee

(10) Patent No.: US 6,637,922 B2
(45) Date of Patent: Oct. 28, 2003

(54) BRIGHTNESS ENHANCED HEAD LAMP APPARATUS

(75) Inventor: Sung Wu Lee, Banchiau (TW)

(73) Assignee: Demax Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/983,836

(22) Filed: Oct. 26, 2001

(65) Prior Publication Data

US 2003/0081426 A1 May 1, 2003

(51) Int. Cl.[7] ..... F21V 13/02

(52) U.S. Cl. ..... 362/544; 362/507; 362/242; 362/247; 362/216

(58) Field of Search ..... 362/544, 507, 362/242, 247, 459, 487, 505, 506, 540, 543, 545, 227, 235, 236, 237, 34, 84, 216, 228

(56) References Cited

U.S. PATENT DOCUMENTS 1,351,635 A * 8/1920 Forsberg ..... 362/540
2,078,573 A * 4/1937 Johnson ..... 362/544
2,094,089 A * 9/1937 Baker ..... 362/544
3,529,287 A * 9/1970 Southerland ..... 340/929
3,759,084 A * 9/1973 Plewka ..... 362/544
3,895,345 A * 7/1975 Elvers et al. ..... 340/331
4,206,498 A * 6/1980 Kader ..... 362/544
4,646,208 A * 2/1987 Hayashi et al. ..... 362/84
4,654,758 A * 3/1987 Szekacs ..... 362/516
4,794,494 A * 12/1988 Reeder ..... 362/84
4,949,226 A * 8/1990 Makita et al. ..... 362/544
5,611,612 A * 3/1997 Choji et al. ..... 362/267
5,702,173 A * 12/1997 Kawamura ..... 362/544
5,709,453 A * 1/1998 Krent et al. ..... 362/84
5,785,413 A * 7/1998 Tillinghast et al. ..... 362/459
6,109,769 A * 8/2000 Lakosky ..... 362/544
6,123,440 A * 9/2000 Albou ..... 362/516
6,129,447 A * 10/2000 Futami ..... 362/522
6,155,694 A * 12/2000 Lyons et al. ..... 362/245

* cited by examiner

*Primary Examiner*—Alan Cariaso
*Assistant Examiner*—Ismael Negron
(74) *Attorney, Agent, or Firm*—Rosenberg, Klein & Lee

(57) ABSTRACT

A brightness enhanced head lamp includes a hyperboloid reflecting mirror disposed within a housing, a head lens member coupled to the housing to extend transaxially across a front portion of the hyperboloid reflecting mirror, and a primary light source disposed between the hyperboloid reflecting mirror and the head lens member. The head lamp further includes a secondary light source disposed between the head lens member and the front portion of the hyperboloid reflecting mirror for augmenting the light generated by the primary light source. In certain embodiments, the secondary light source is formed with a fluorescent material disposed at an inner surface of the head lens member. In certain other embodiments, an auxiliary lighting element is disposed adjacent the fluorescent material, such that the fluorescent material may be further illuminated to emit fluoresced light responsive thereto.

6 Claims, 3 Drawing Sheets

BRIGHTNESS ENHANCED HEAD LAMP APPARATUS

FIELD OF THE INVENTION

The present invention relates to a device to enhance the brightness for head lamp, and especially to a head lamp for a vehicle that includes in one embodiment a circular neon light tube installed about an inner periphery of a hyperboloid reflecting mirror, and in another embodiment includes such features as a layer of fluorescent material coated onto an inner surface of a lens illuminated by a proximately disposed additional bulb.

BACKGROUND OF THE INVENTION

Typically, only small secondary lamps of a vehicle are actuated at dusk or other conditions where lamp illumination is to serve primarily for indicating the presence of the vehicle. However, light emitted from a small lamp is often not sufficiently strong to attract the attention of others to the light. As a consequence, otherwise avoidable accidents occur as people are not adequately alerted to approaching vehicles. Therefore, the alerting function of conventional small lamps is limited, as they are not sufficiently conspicuous to other drivers or pedestrians.

Therefore, there is a need for a novel device which can improve upon the aforesaid defects of the prior art.

SUMMARY OF THE INVENTION

Accordingly, the primary object of the present invention is to provide a brightness enhanced head lamp having an additional lighting element which is preferably a neon lamp tube. A neo lamp tube of a predetermined size is installed between a hyperboloid reflecting mirror and a head lens of the head lamp. A primary bulb of the lamp is illuminated with the neon lamp tube at the same time. Aided by the hyperboloid reflecting mirror, the lens is very brightly illuminated so that driving safety is promoted.

Accordingly, the primary object of the present invention is to provide a brightness enhanced head lamp having an additional lighting element which is preferably a neon lamp tube. A neon lamp tube of a predetermined size is installed between a hyperboloid reflecting mirror and a head lens of the head lamp. A primary bulb of the lamp is illuminated with the neon lamp tube at the same time. Aided by the hyperboloid reflecting mirror, the lens is very brightly illuminated so that driving safety is promoted.

A further object of the present invention is to provide a brightness enhanced head lamp, wherein an inner periphery of the surface of the lens is coated in another embodiment with a layer of light fluorescing material. As the bulb is illuminated, focusing of the mirror-reflected light is enhanced. Therefore, safe driving conditions are promoted.

BRIEF DESCRIPTION OF THE DRAWINGS

The various objects and advantages of the present invention will be more readily understood from the following detailed description when read in conjunction with the appended drawings.

DETAILED DESCRIPTION OF THE PREFERRED EMBODIMENTS

Figure 1B:
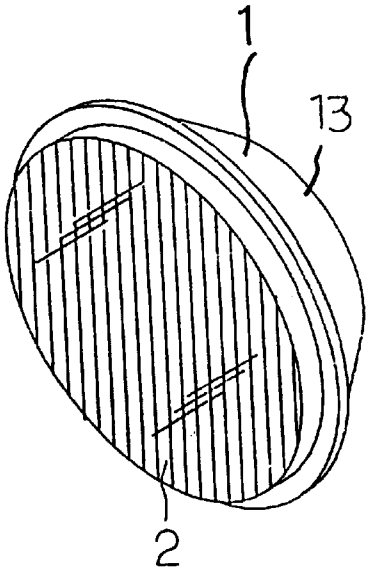
FIG. 1B is a perspective view of a small lamp of the present invention.
Figure 1A:
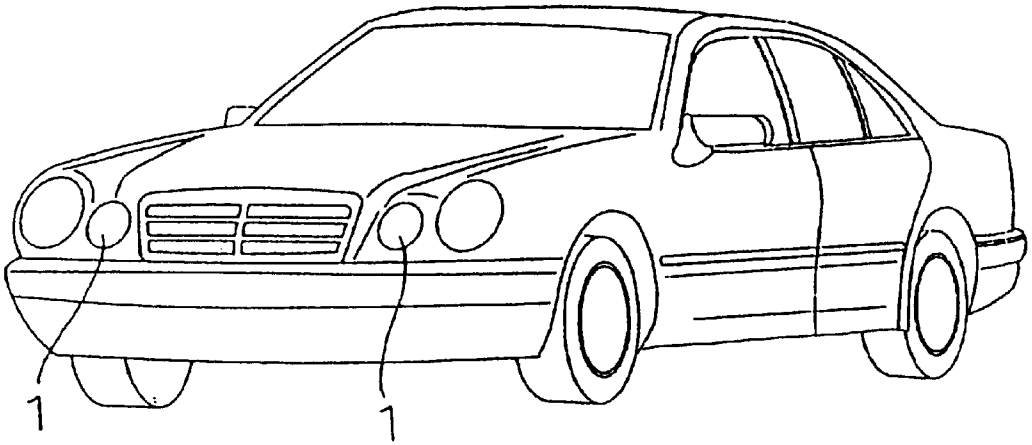
FIG. 1A is a schematic view of the mounting structure for the present invention.
Figure 1C:
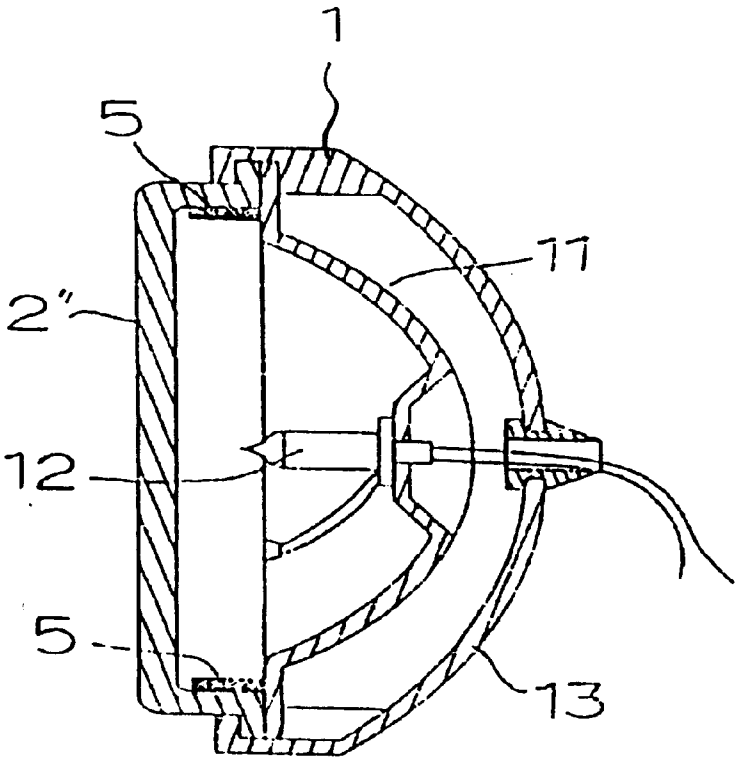
FIG. 1C is a sectional view in one embodiment of a small lamp of the present invention.

Referring to FIGS. 1A, 1B, and 1C, a brightness enhanced head lamp for use in a vehicle is illustrated. The brightness enhanced head lamp may be suitably received in various lamp seats. In general, the seat 1 is formed by a housing 13 with a hyperboloid reflecting mirror 11. A primary bulb 12 is disposed at the center portion thereof; and, a head lens 2 is installed across an outer opening of the housing 13. Therefore, when the bulb 12 is illuminated, the light impinging upon the hyperboloid reflecting mirror 11 will be focused through the head lens 2 so as to serve an alerting function by illumination. In accordance with one aspect of the present invention, a light fluorescing element or coating 5 may be disposed at an inner periphery of the head lens 2", as shown in FIG. 1C.

Figure 2:
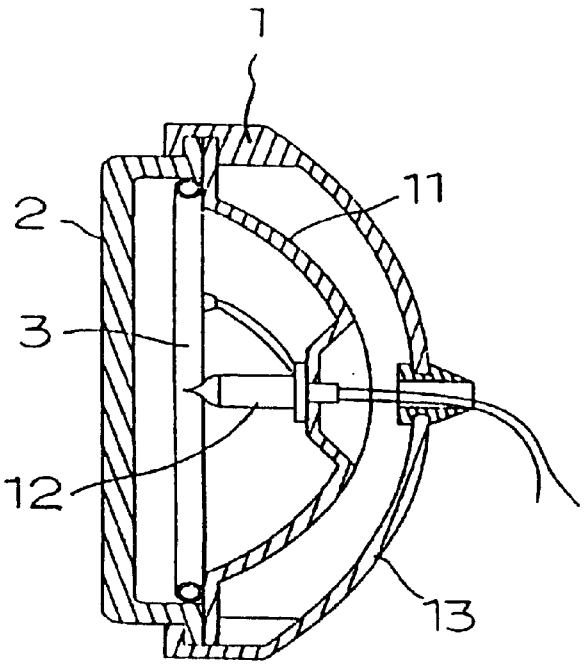
FIG. 2 is a schematic view showing the configuration in a second embodiment of the present invention.

In accordance with another aspect of the present invention, a neon tube 3 corresponding in size to the edge of the lamp frame is installed between the hyperboloid reflecting mirror and the head lens 2 of the seat 1, as illustrated in FIG. 2. When the bulb 12 and neon lamp tube 3 are illuminated at the same time, the hyperboloid reflecting surface of the whole mirror 11 is very brightly illuminated for reflecting through the head lens so as to be highly conspicuous to drivers of other oncoming vehicles, as well as to pedestrians nearby. Therefore, the likelihood of an accident is reduced.

Figure 3:
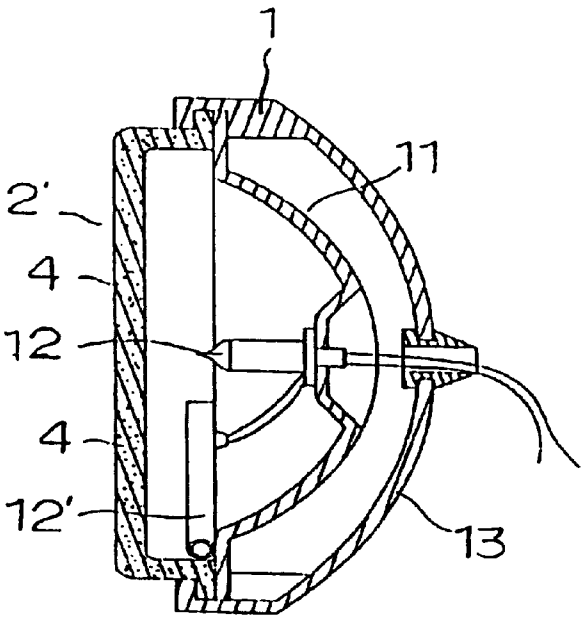
FIG. 3 is a schematic view showing another configuration in a third embodiment of the present invention.

In another embodiment shown in FIG. 3, the seat 1 and head lens 2' may contain a fluorescent material 4. An auxiliary light source 12' is placed between the hyperboloid reflecting mirror 11 and the head lens 2'. The fluorescent material 4 fluoresces upon absorbing light generated by the head lamp's light sources. When the two bulbs 12 and 12' are illuminated, the fluorescent material 4 in the head lens 2' will enhance the overall light intensity so that the whole head lens surface will brighten. Drivers of oncoming cars or motorcycles and pedestrians are thus more likely to take notice of the given vehicle. Thereby alerted, the drivers and pedestrians may take care to avoid collision, so that safety is enhanced.

In summary, no matter what configuration described above is employed, the objects of alerting and heightening safe driving conditions are achieved. Therefore, the present invention promotes traffic safety, and reduces the likelihood of harm due to carelessness or inattention.

The present invention is thus described, but it will be obvious that the same may be varied in many ways. Such variations are not to be regarded as a departure from the spirit and scope of the present invention, and all such variations or modifications as would be obvious to one skilled in the art are intended to be included within the scope of the present invention as defined in the following claims.

What is claimed is:

1. A brightness enhanced head lamp comprising:

(a) a hyperboloid reflecting mirror disposed within a housing;

(b) a head lens member coupled to said housing, said head lens member extending transaxially across a front portion of said hyperboloid reflecting mirror;

(c) a primary light source disposed between said hyperboloid reflecting mirror and said head lens member; and, (d) a secondary light source disposed between said head lens member and said front portion of said hyperboloid reflecting mirror in optical communication with said primary light source for augmenting the light generated by said head lamp.

2. The brightness enhanced head lamp as recited in claim 1 wherein said secondary light source includes a fluorescent material coating an inner surface of said head lens member for emitting fluoresced light responsive to illumination of said primary light source.

3. The brightness enhanced head lamp as recited in claim 2 wherein said secondary light source further includes an auxiliary bulb disposed adjacent said fluorescent material coating for the illumination thereof.

4. The brightness enhanced head lamp as recited in claim 2 wherein said fluorescent material coating is formed to extend along at least a portion of an inner circumferential periphery of said head lens member.

5. A brightness enhanced head lamp comprising:

(a) a hyperboloid reflecting mirror disposed within a housing;

(b) a head lens member coupled to said housing, said head lens member extending transaxially across a front portion of said hyperboloid reflecting mirror;

(c) a primary light source disposed between said hyperboloid reflecting mirror and said head lens member; and, (d) a secondary light source disposed between said head lens member and said front portion of said hyperboloid reflecting mirror for augmenting the light generated by said head lamp, said secondary light source including an annular neon tube coaxially disposed about said front portion of said hyperboloid reflecting mirror.

6. A brightness enhanced head lamp comprising:

(a) a hyperboloid reflecting mirror disposed within a housing;

(b) a head lens member coupled to said housing, said head lens member extending transaxially across a front portion of said hyperboloid reflecting mirror, said head lens member defining an inner surface opposing said front portion of said hyperboloid reflecting mirror;

(c) a primary light source disposed between said hyperboloid reflecting mirror and said head lens member; and, (d) an secondary light source in optical communication with said primary light source for augmenting the light generated by said head lamp, said secondary light source including a fluorescent material disposed on at least a portion said inner surface of said head lens member, and an auxiliary lighting element disposed adjacent said fluorescent material, between said head lens member and said hyperboloid reflecting mirror.

* * * * *